US005864283A

United States Patent [19]

Weinstein

[11] Patent Number: 5,864,283

[45] Date of Patent: Jan. 26, 1999

[54] MICROWAVE FREQUENCY CHIP RESISTOR ASSEMBLY

[75] Inventor: David I. Weinstein, Yorktown Heights, N.Y.

[73] Assignee: King Electronics Co., Inc., Rock Hill, S.C.

[21] Appl. No.: 764,137

[22] Filed: Dec. 12, 1996

[51] Int. Cl.[6] ..... H01C 13/00

[52] U.S. Cl. ..... 338/216; 338/220; 338/221; 338/233; 338/234; 333/81 R

[58] Field of Search ..... 338/216, 220, 338/221, 233, 234, 235, 236, 237, 271, 272, 309, 313, 316; 333/81 A, 81 R

[56] References Cited

U.S. PATENT DOCUMENTS

| | | | |
|---|---|---|---|
| 1,991,574 | 2/1935 | Rabezzana | 338/66 |
| 2,389,466 | 11/1945 | Stoffel | 338/66 |
| 2,487,098 | 11/1949 | Carington et al. | 439/750 |
| 2,965,858 | 12/1960 | Palmer et al. | 333/81 R |
| 3,227,975 | 1/1966 | Hewlett et al. | 333/81 R |
| 3,621,479 | 11/1971 | Peterson et al. | 333/81 A |
| 3,890,028 | 6/1975 | Blanchenot | 439/133 |
| 4,011,531 | 3/1977 | Gaudet | 333/81 A |
| 4,107,633 | 8/1978 | Bacher | 333/81 A |
| 5,322,981 | 6/1994 | Mazzochette et al. | 338/216 |

*Primary Examiner*—Renee S. Luebke
*Assistant Examiner*—Karl Easthom
*Attorney, Agent, or Firm*—Jordan B. Bierman; Bierman, Muserlian and Lucas

[57] ABSTRACT

The microwave frequency chip resistor assembly is used as a terminating device for a video jack. Such an assembly minimizes inductance variation and eliminate soldering associated with conventional metal film resistors.

3 Claims, 3 Drawing Sheets

MICROWAVE FREQUENCY CHIP RESISTOR ASSEMBLY

BACKGROUND OF THE INVENTION

1. Field of the Invention

The present invention is directed to a microwave frequency chip resistor assembly and, more specifically, to a chip resistor for terminating unused transmission lines to avoid interference with other signals.

2. Description of Related Art

As the TV industry uses more and more Serial Digital Data Signals for transmitting Television Signals and moves closer to a practical HDTV system, unterminated transmission lines must be terminated or risk interfering with other signals in the system.

Video jacks are commonly used switches in television studio master control rooms and editing suites. With the advent of Serial Digital techniques, unused signals in the switches must be terminated or risk interfering with the other transmission lines within the jack due to the high data rates. Conventionally, standard metal film resistors have been used as the terminating device.

In order to minimize reflections, the standard metal film resistor is soldered into a cylindrical housing of dimensions that provide a matched impedance (typically 75 ohms). As shown in FIG. 1, standard metal film resistor A is soldered in place at points B and C within housing D. This assembly is then installed in the video jack. A problem occurs because at microwave frequencies of 1 Ghz and above, variations in the reactance of the standard metal film resistor are significant. Typical metal film resistors are laser trimmed by etching a spiral groove in the body of the resistor to achieve a desired resistance. This causes variation in inductance due to the laser trimming and results in a need to vary the housing dimensions.

Additionally, soldering is a time-consuming operation that requires skilled operators, and the process requires cleaning of the assembly after the soldering process. Also, the variation of inductance in the metal film resistor causes unreliable microwave performance.

SUMMARY OF THE INVENTION

In view of the foregoing, it is the object of the present invention to provide a well matched resistive termination for unused signals that eliminates the need for soldering and minimizes inductance variations inherent in the construction of traditional cylindrical metal film technology resistors.

It has been discovered that by using a thick film, alumina porcelain substrate chip resistor in conjunction with a housing, a spring and a press on cap to hold the chip resistor in place, there is no need for soldering, and inductance variations are minimized.

The use of chip resistors in this manner is unique because surface mounted devices such as chip resistors are normally placed on a printed circuit board and soldered in place. The chip resistor, by itself, is normally used at DC or very low frequencies. It is the design of the cavity into which it is placed in accordance with the present invention that makes the entire assembly perform at microwave frequencies up to 1 Ghz. It is the low inductance characteristics, small physical size and the ability to mount without soldering that makes the chip resistor useful in the present invention.

Other objects and features of the present invention will become apparent from the following detailed description considered in conjunction with the accompanying drawings.

DETAILED DESCRIPTION OF THE INVENTION

Figure 1:
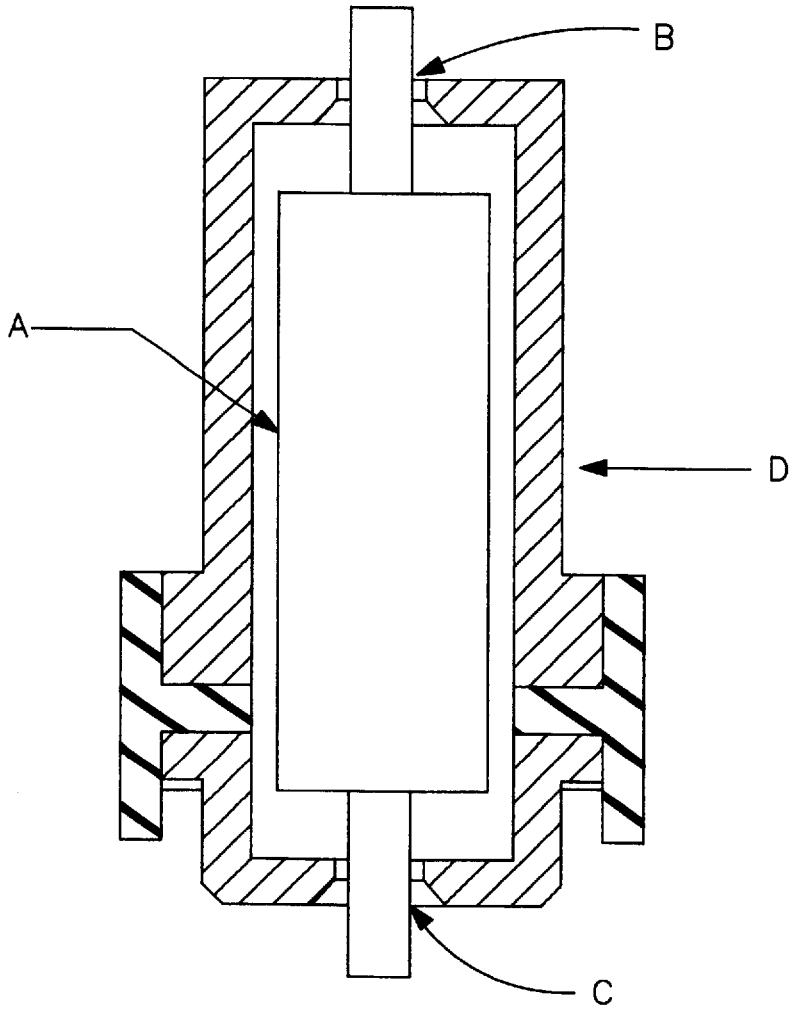
FIG. 1 PRIOR ART
FIG. 1 is a cross-sectional view of a conventional standard metal film resistor assembly.
Figure 2:
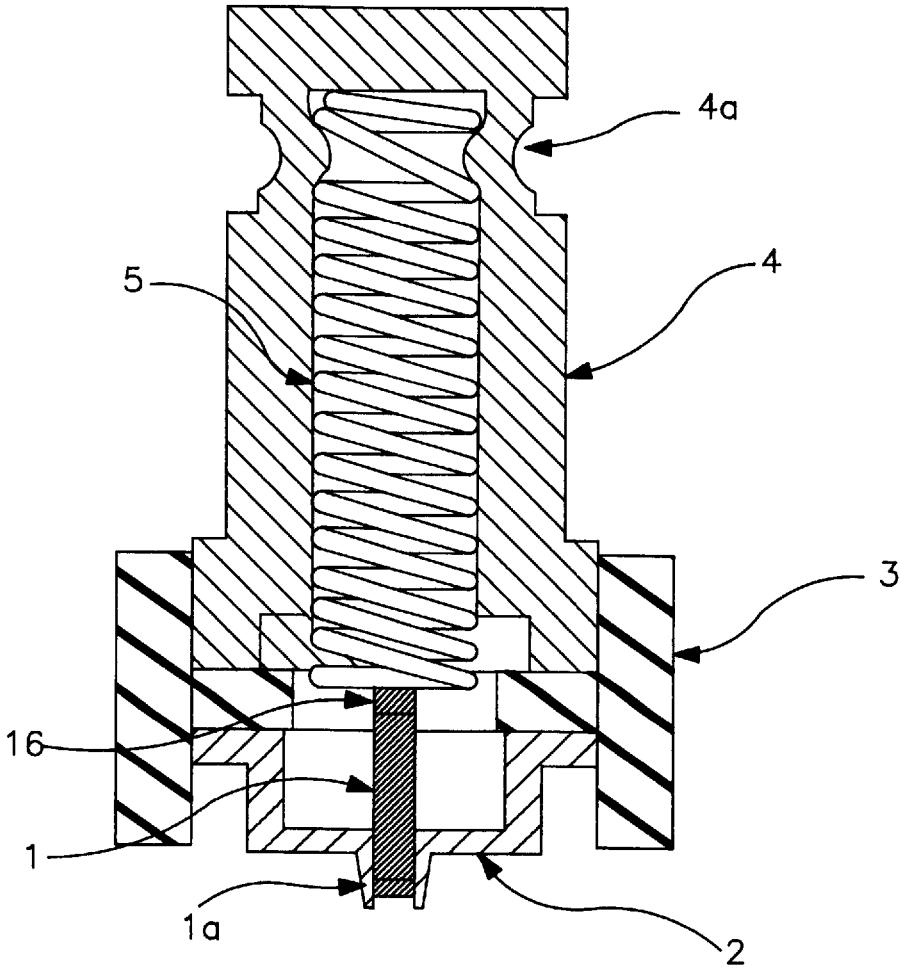
FIG. 2 is a cross-sectional view of the inventive microwave frequency chip resistor assembly.

Referring to FIG. 2, the inventive microwave frequency chip resistor assembly is shown therein. The inventive microwave frequency chip assembly comprises chip resistor 1 held in place by press-in cap 2. Press-in cap 2 is held in insulator 3 which also holds housing 4. Inside housing 4 is compression spring 5.

The preferred microwave chip resistor used in the present invention is a thick film, alumina porcelain substrate chip resistor. Such chip resistors are conventional and manufactured by SFI Corporation under part No. type RMC 1/4 75 1%. Such a resistor has a resistance of 75 ohms±1%. Its useable frequency range is dependent on the dimensions of the cavity into which it is mounted, typically 1 Ghz.

The physical size of the chip, in and of itself is not critical. The inner diameter of housing 4, insulator 3 and press-in cap 2 can be adjusted to provide a well matched microwave cavity for any size chip. The size is only important with respect to the amount of space within the connector that is available for the entire assembly and the smaller the chip, the less variation there will be in inductance and capacitance. Naturaly, the smaller, the better, up to a point. When the chip is very small, it becomes hard to handle physically. It is preferred to use a chip having the dimensions 0.100"×0.122"×0.021".

The compression spring used in the inventive assembly can be any conventional compression spring. Preferably, the compression spring is a coiled compression spring as shown in FIG. 2. The spring performs two functions. It provides both the mechanical and electrical points of contact beteen the chip resistor and the housing. All points of contact are preferably gold plated for good conductivity. In addition, the spring compensates for the build-up of mechanical tolerances. The spring allows the chip to be inserted into the press-in cap without concern for exact positioning.

In order to assemble the inventive chip resistor assembly as shown in FIG. 2, chip resistor 1 is pressed into press-in cap 2. Insulator 3 has an H-shaped cross-section as FIG. 2 depicts and isolates the housing 4 from the cap 2. Spring 5 is captivated by staking in housing 4 and this sub-assembly is then inserted onto the upper half of H-shaped insulator 3. The lower half of the H-shaped insulator holds cap 2. Spring 5 compensates for tolerance variations. Cap 2 and housing 4 extend out of and beyond the lower and upper halves of H-shaped insulator 3, respectively. A press fit action holds all of the components together before the final assembly is completed. Electrical and mechanical contact is maintained at points 1*a* and 1*b*. Spring 5, which is preferably either gold plated stainless steel or gold plated music wire, provides the conducting path for chip resistor 1 to make contact with housing 4 at the point where the spring is staked in place, 4*a*.

Figure 3:
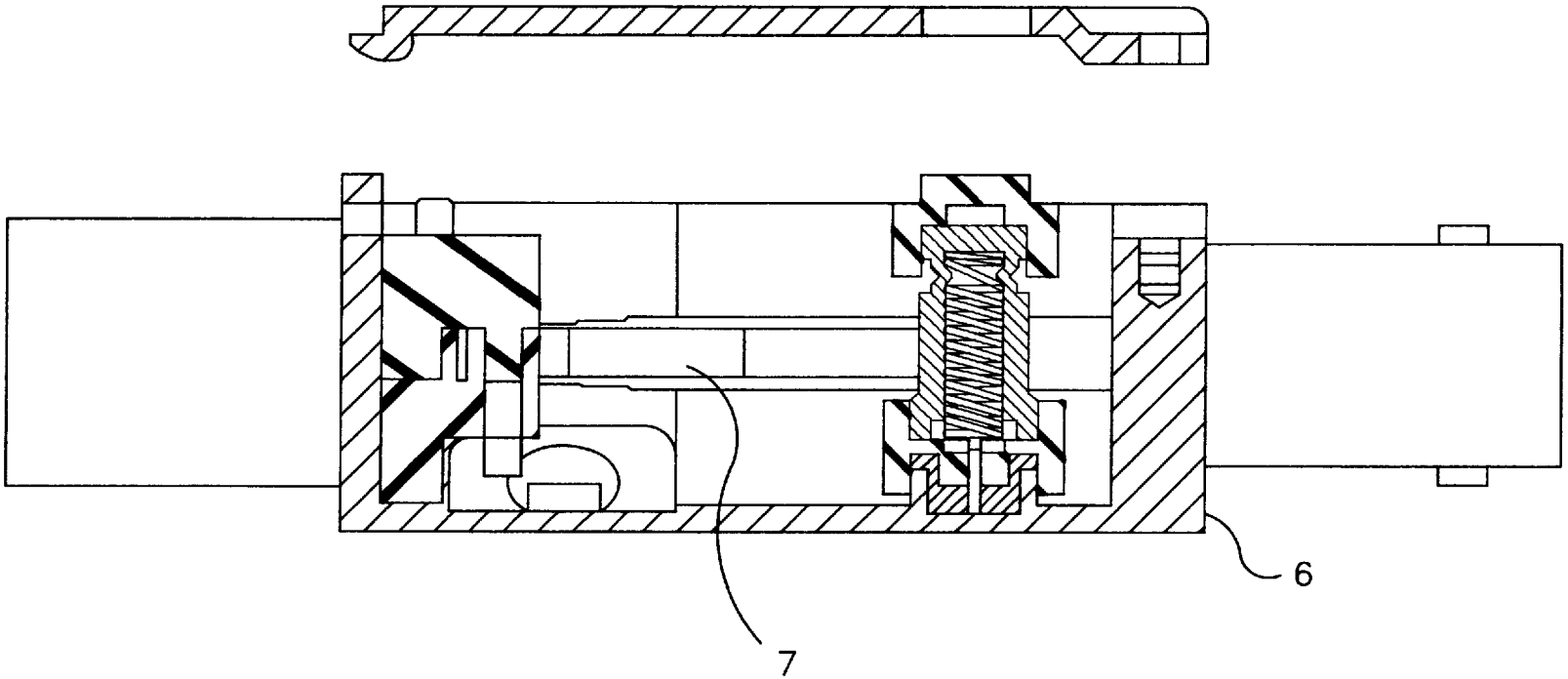
FIG. 3 is a cross-sectional view of the inventive microwave frequency chip resistor assembly in a video jack.

FIG. 3 depicts the inventive microwave chip resistor assembly as shown in FIG. 2 inserted into a video jack assembly. As shown in FIG. 3, the inventive microwave chip resistor assembly is pressed into the larger jack assembly 6.

The entire assembly is stationary when mounted in jack 6. The press-in cap is pressed into the video jack. Floating V-spring 7 (see U.S. Pat. No. 5,518,414) in the jack makes contact with the outer diameter of housing 4.

While only fundamental novel features of the invention, as applied to a preferred embodiment thereof, specifically, for use with a video jack have been expressly described, it is understood that the invention is adaptable for use with all types of jacks, and that various omissions, substitutions, and changes in the form and details of the device illustrates, and in its operation, may be made by those skilled in the art without departing from the spirit of the invention. It is therefore the intention of Applicants that the invention be limited only as indicated by the scope of the claims appended hereto.

We claim:

1. A microwave frequency chip resistor assembly comprising:

(a) a microwave chip resistor press mounted in a cap so as to securely hold said chip resistor in said cap;

(b) a compression spring mounted within a housing such that said spring is staked in said housing; and (c) an H-shaped insulator having an H-shaped cross section, the upper half of said H-shaped insulator holding said housing in which said compression spring is mounted, said housing extending out of and beyond said upper half of said H-shaped insulator, and the lower half of said H-shaped insulator holding said cap in which said chip resistor is press mounted, said cap extending out of and beyond said lower half of said H-shaped insulator.

2. The microwave frequency chip resistor assembly of claim 1 wherein said compression spring is a coil compression spring.

3. The microwave frequency chip resistor assembly of claim 1 wherein said chip resistor is a thick film, alumina porcelain substrate chip resistor.

* * * * *

UNITED STATES PATENT AND TRADEMARK OFFICE
CERTIFICATE OF CORRECTION

PATENT NO. : 5,864,283

DATED : January 26, 1999

INVENTOR(S) : Weinstein

It is certified that error appears in the above-identified patent and that said Letters Patent is hereby corrected as shown below:

On the title page,

[73] Assignee's name, "King" should read --Kings--.

[56] References Cited, U.S. PATENT DOCUMENTS, line 9, "Bacher" should read --Scaletta--; line 10, "5,322,981 6/1994" should read --5,332,981 7/1994--; add --4,117,425 9/1978 Bacher--.

Signed and Sealed this

Eighth Day of June, 1999

*Attest:*

Q. TODD DICKINSON

*Attesting Officer*

*Acting Commissioner of Patents and Trademarks*